United States Patent [19]

LaFleur

[11] 4,071,187

[45] Jan. 31, 1978

[54] VALVE BAG

[76] Inventor: Arthur E. LaFleur, 273 River St., Manistee, Mich. 49660

[21] Appl. No.: 667,098

[22] Filed: Mar. 15, 1976

[51] Int. Cl.[2] ..... B65D 31/14

[52] U.S. Cl. ..... 229/62.5; 206/813; 229/DIG. 14

[58] Field of Search ..... 229/62.5, 62, DIG. 14; 150/9; 206/813

[56] References Cited

U.S. PATENT DOCUMENTS

| | | | |
|---|---|---|---|
| 2,105,376 | 1/1938 | Scott | 229/62.5 |
| 2,805,183 | 9/1957 | Higgins | 206/813 X |
| 3,143,278 | 8/1964 | Hiebert | 229/62 |
| 3,167,241 | 1/1965 | Woerner | 229/62.5 |
| 3,221,789 | 12/1965 | Harding | 229/62.5 X |
| 3,236,438 | 2/1966 | Rhodes | 229/62.5 |
| 3,942,713 | 3/1976 | Olson et al. | 229/62 |

FOREIGN PATENT DOCUMENTS

| | | | |
|---|---|---|---|
| 701,859 | 1/1965 | Canada | 229/62.5 |
| 1,085,027 | 7/1960 | Germany | 229/62.5 |
| 980,999 | 1/1965 | United Kingdom | 229/62.5 |

*Primary Examiner*—Stephen P. Garbe
*Attorney, Agent, or Firm*—Barnes, Kisselle, Raisch & Choate

[57] ABSTRACT

A bag of the type having a side and a closed end which adjoin at corner portions which are turned inwardly to form a valve opening. The bag is made of a thermoplastic material, and a flap of thermoplastic material is secured around the interior of the valve opening by heat sealing. The heat sealed regions are arranged to form, in addition to the valve opening, a vent passageway system for quickly venting air from the bag during and immediately subsequent to filling. The flap is relatively flexible and projects into the bag beyond the valve opening to effectively close the valve opening and prevent loss of contents after the bag has been filled. In one form, the flap is formed with a cuff which projects exteriorly of the valve opening and has interior surfaces heat sealable to provide a moistureproof closure for the opening.

11 Claims, 23 Drawing Figures

FIG. 7
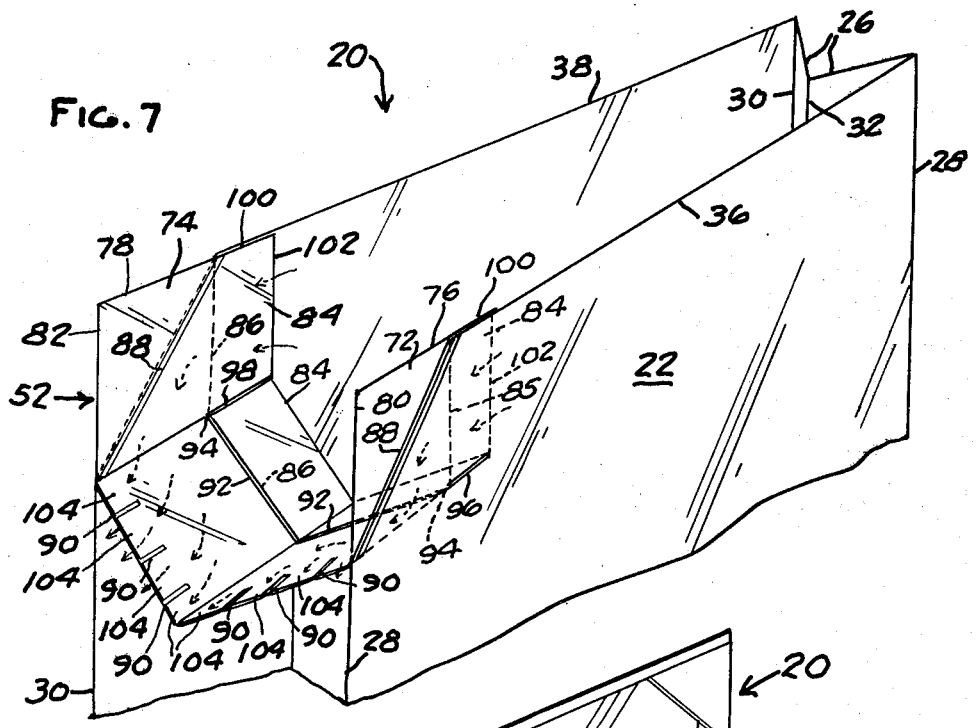
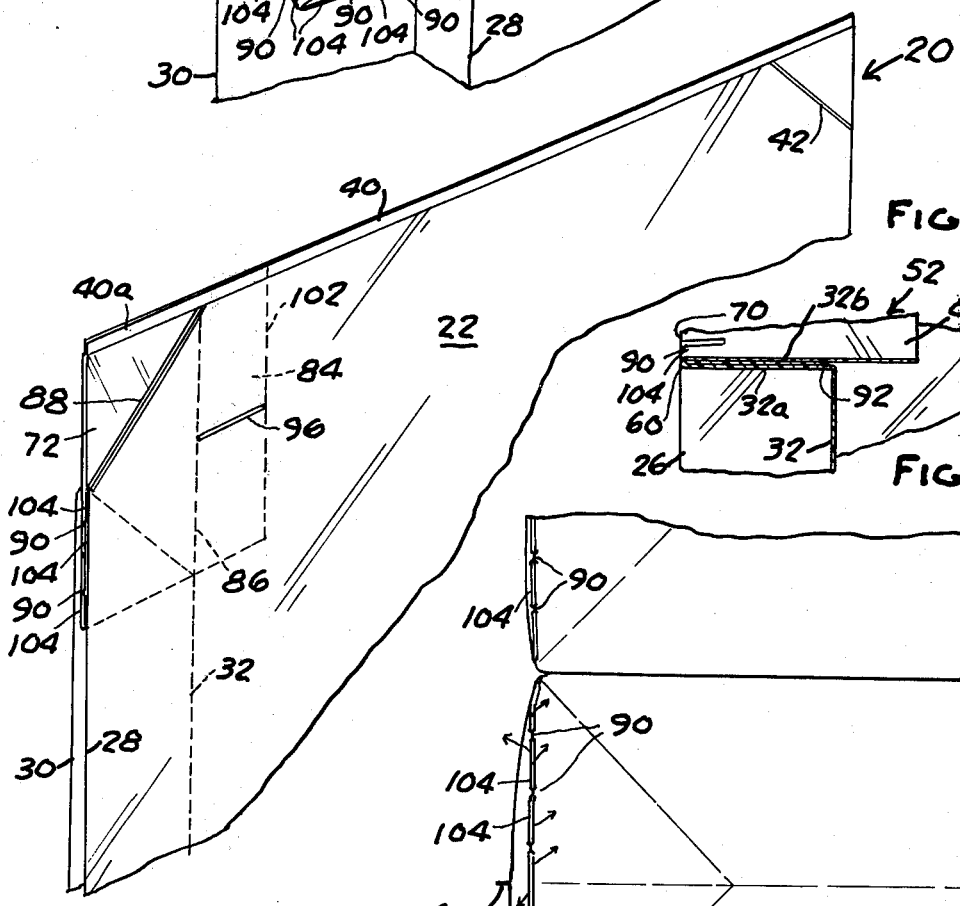
FIG. 8
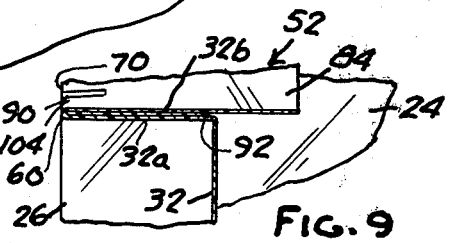
FIG. 9
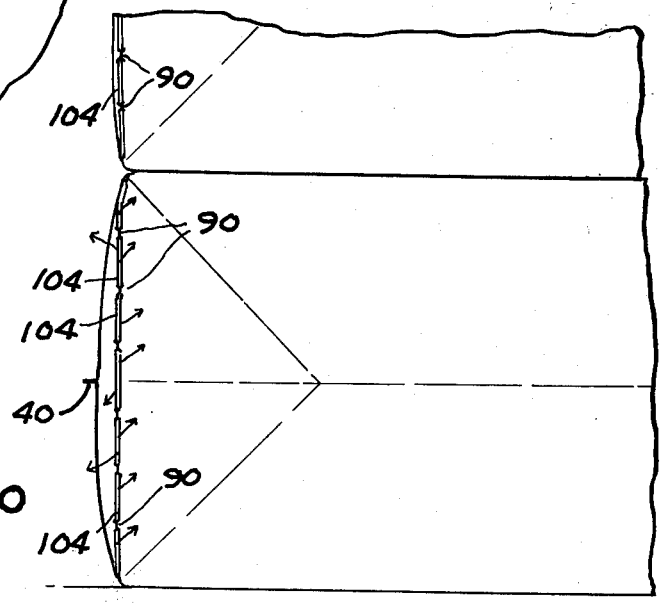
FIG. 10

VALVE BAG

This invention relates to a bag of the type commonly referred to as a valve bag. Such a bag has closed ends and sides, one end adjoining a side in corner portions which are folded inwardly to form the valve opening. The bag is filled by inserting a fill nozzle into the bag through the valve opening.

Typically, valve bags are filled and then stacked for subsequent handling at a high rate of production. However, conventional valve bags have a characteristic which results in a production bottle neck, namely, air which enters the bag during the filling process causes the front and back panels of the bag to bulge outwardly. When the nozzle is withdrawn from the valve opening, the opening closes and traps the excess air within the bag. The bulging panels interfere with proper stacking and subsequent handling of the bags. Eventually, the air leaks out through the valve opening, but this may take as long as two minutes or more, and in the meantime production is slowed. The problem is aggravated when the bags are formed of a plastic material since the plastic is relatively slippery, and bulge-sided bags tend to slide off of one another.

Conventional valve bags have another characteristic which shortens the shelf life of any hygroscopic contents which they might contain: moisture or moisture laden air can readily pass through the opening to react with the contents.

The object of the present invention is to provide a relatively simple, inexpensive valve bag structure which is improved to include, in addition to the valve opening, a passageway system for relatively quickly venting air from the bag both during the filling procedure and immediately thereafter, and to include an improved closure, optionally moistureproof, for the valve opening. One form of the invention is shown in the accompanying drawings.

FIG. 7 is a fragmentary perspective view illustrating a subsequent step in forming the bag.

FIG. 8 is a fragmentary perspective view of the bag in completed condition.

FIG. 9 is a fragmentary enlarged scale view of the upper left corner portion of the bag illustrated in FIG. 1.

FIG. 10 is a view generally in end elevation of a pair of filled bags in stacked relation and illustrating operation of vent ports in the bags.

Figure 1:
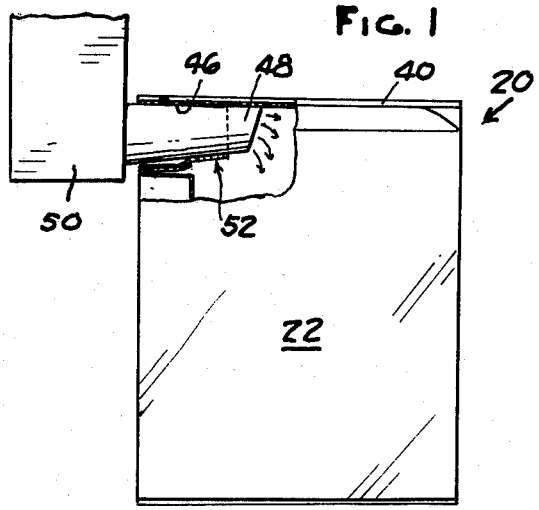
FIG. 1 is a view generally in front elevation with parts broken away and shown in section illustrating a bag according to the invention being filled.
Figure 2:
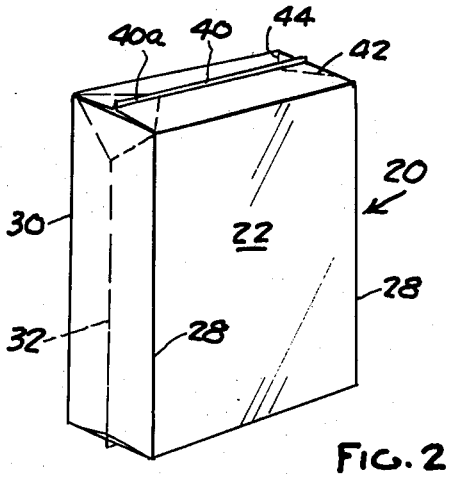
FIG. 2 is a perspective view of the bag in filled condition.
Figure 5:
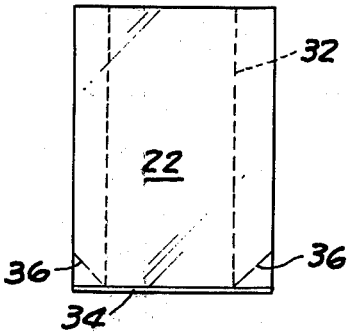
FIG. 5 is a view generally in front elevation illustrating a subsequent step in forming the bag.

Illustrated in the drawings is a bag 20 having front and back panels 22,24 which define the side walls of the bag and longitudinally extending side gusset panels 26 which form the end wall of the bag. Panels 22,24 respectively adjoin panels 26 at fold lines 28,30 and panels 26 are adjoined at fold lines 32. In the illustrated structure, panels 22–26 are made of a thermoplastic material and the bottom edges of panels 22,24 and 26 are heat sealed together to form a bottom closure seam 34. The overlying portions of panels 22,24 and 26 are also heat sealed together at 36 along diagonal lines adjacent bottom corners of bag 20, as shown in FIG. 5. Panels 22,24 have top edge portions 36,38, respectively, which are heat sealed together to form a top closure seam 40 (FIGS. 2 and 8). Panels 22,24 respectively are heat sealed to their contiguous gusset panels 26 along diagonal lines 42,44 adjacent one top corner of the bag. The strengthening effect of seals 40,42,44 is described in my prior U.S. Pat. No. 3,143,277. As is brought out in more detail below, portions of the bag at the other upper corner are folded inwardly to define a valve opening 46 for receiving a filler nozzle 48 on a filling device 50.

Figure 3:
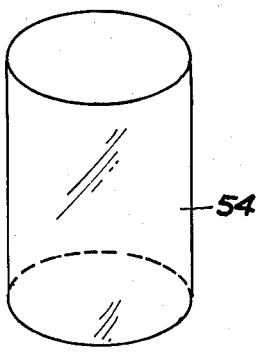
FIG. 3 is a perspective view of a tube from which the bag is fashioned.
Figure 4:
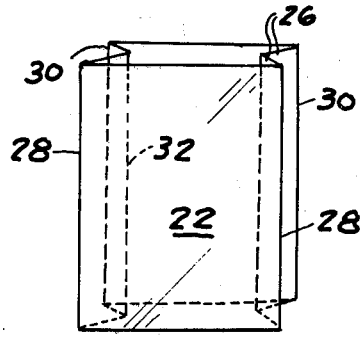
FIG. 4 is a perspective view illustrating a gusseting step in formation of the bag.

In accordance with the invention, a flap 52 of thermoplastic material, preferably the same as that forming panels 22–26, is secured around the interior of opening 46 in such a manner as to form a passageway system for venting air from within bag 20. The paths followed by the venting air are illustrated generally by the arrows in FIG. 7. Preparatory to assembling flap 52 within opening 46, the general bag structure is formed by providing a cylindrical tube 53 (FIG. 3) of thermoplastic material and folding the tube at longitudinally extending locations diametrically opposite each other along lines 28–32 to form panels 22–26 (FIG. 4).

Figure 6:
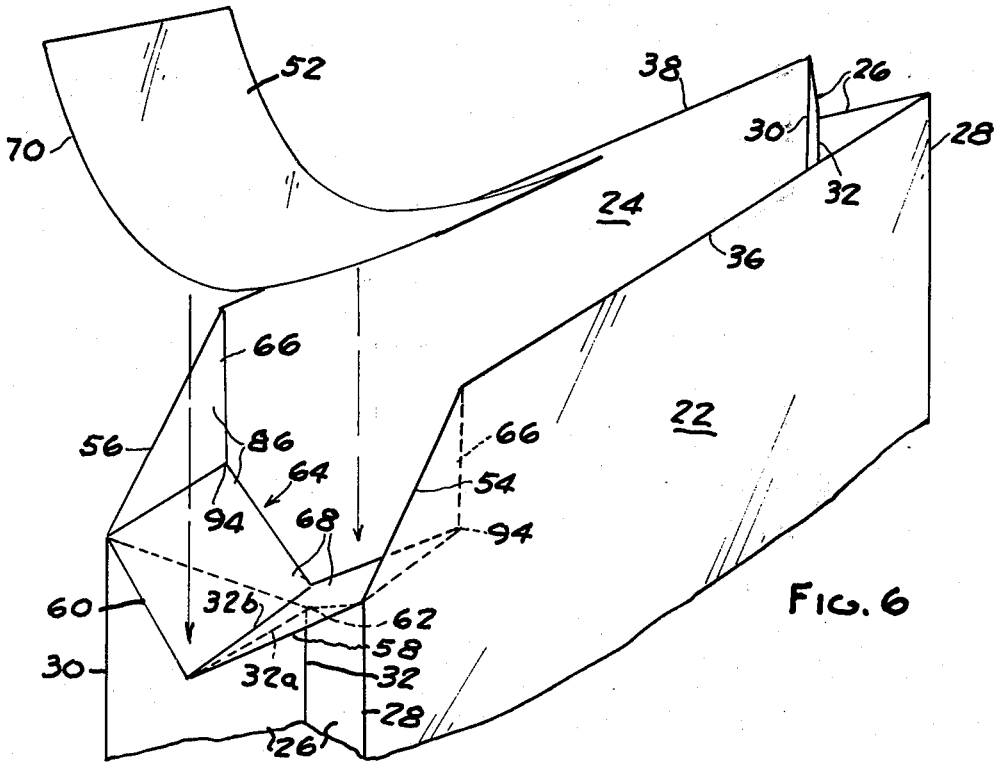
FIG. 6 is an enlarged scale fragmentary, exploded perspective view illustrating a further step in forming the bag.
Figure 11:
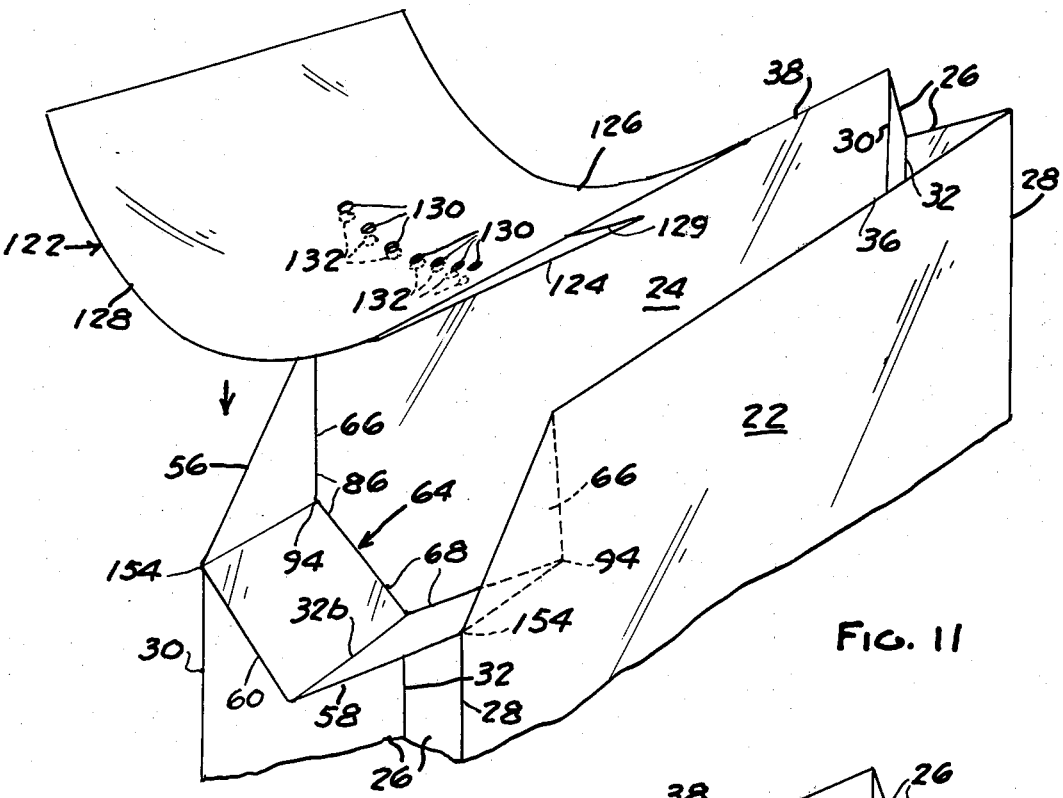
FIG. 11 is a view similar to FIG. 6 but showing a step in forming a modified bag according to the invention.
Figure 14:
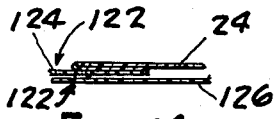
FIG. 14 is a generally sectional view on line 14—14 of FIG. 12.
Figure 13:
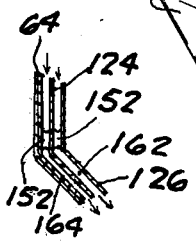
FIG. 13 is a partly diagrammatic sectional view on line 13—13 of FIG. 12.
Figure 12:
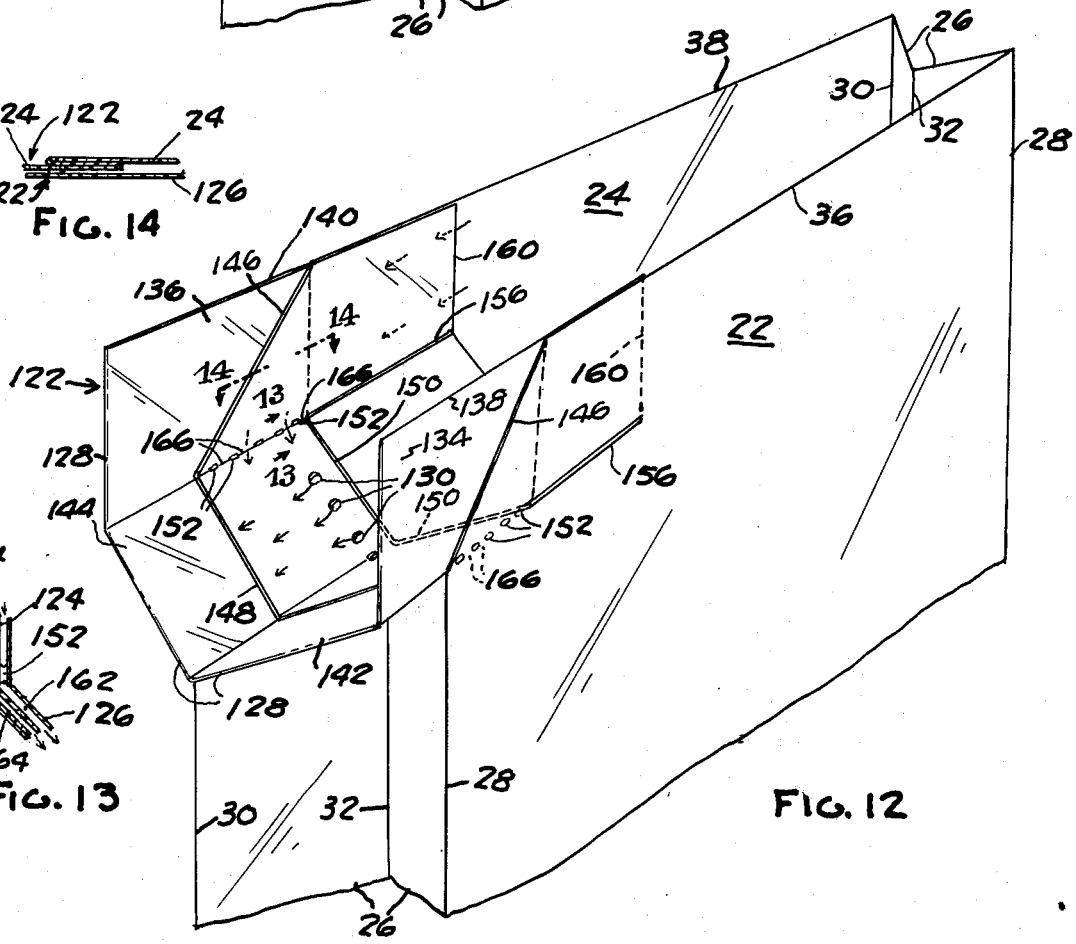
FIG. 12 is a fragmentary perspective view illustrating a subsequent step in forming the bag of FIG. 11.

Opening 46 may be formed either before or after formation of bottom seal 34 and diagonal seal lines 36. In either event, to form opening 46, a pair of gusset panels 26 are folded outwardly and then doubled back inwardly along fold lines 54,56 which extend diagonally across top corner portions of panels 22,24 and which are connected by fold portions 58,60 extending between panels 22,24 (FIG. 6). During this procedure, gusset fold 32 has been turned generally perpendicularly outwardly, as at **32*a*, from a point 62 and has been doubled back on itself from fold 58,60, as at 32***b*. The result is an inwardly turned corner panel 64 comprised of two triangular sections 66 interconnected by a rectangular section 68 whose center is fold line 32*b*. The inner surface portions of corner panel 64 define opening 46.

Flap 52 is fitted against the inner surfaces of panel 64 with an outer edge 70 of the flap overlying outer fold 58,60 of panel 64. Flap 52 has corner portions 72,74 (FIG. 7) with upper edges 76,78 respectively which are disposed in lateral extension of upper edges 36,38 of panels 22,24 to side edges 80,82 which respectively are disposed in extension of folds 28,30. Flap 52 has a rectangular band-shaped portion 84 which projects toward the interior of the bag beyond the inner edge 86 of panel 64.

With flap 52 assembled to the general bag structure as described, the assembly is placed in a suitable conventional heat sealing fixture in which outer surface portions of flap 52 are heat sealed to the opposed inner surface portions of panel 64 adjacent diagonal folds 54,56, as at 88, along a series of lines 90 extending generally perpendicularly away from edge 70 and along a line 92 adjacent inner edge 86 of panel 64. Seal 92 terminates adjacent the inner bottom corners 94 of triangular sections 66 of panel 64.

In this sealing procedure, portions of triangular sections 66 adjacent folds 54,56 are sealed, respectively, to opposed portions of front and back panels 22,24. Also during this procedure, outer surface portions of inward flap extension 84 are sealed to opposed inner surface portions of panels 22,24, respectively, along lines 96,98 (FIGS. 7 and 8) which extend away from the ends 94 of sealed region 92. Finally, upper edges 36,38 of the front and back panels are heat sealed together to form closure 40, and in this step, upper edges 76,78 of flap 52 are heat sealed together to form an extension 40*a* of seam 40 extending laterally outwardly to a side of bag 20. During the latter step, the upper edges 100 of inward flap extension 84 are heat sealed to the overlying portions of panel edges 36,38.

The various sealed regions 88–100 and adjacent unadjoined areas of flap 52 and panels 22,24,64 define a system of passageways through which air within bag 20 can vent to the bag exterior. The system has two branches, each with an inlet 102 at the inner edges of flap extension 84 above seals 96,98. Each branch extends between unadjoined surface areas of extension 84 and a front or back panel 22,24 and continues between unadjoined surface areas of flap 52 and triangular sections 66. The branches open into a common passageway portion between unadjoined surface areas of flap 52 and panel portions 68, this passageway portion communicating to the bag exterior through a series of outlet ports 104 defined by a series of areas between sealed regions 90 in which the opposed surface portions of flap 52 and panel portions 68 are unadjoined.

Prior to use, bag 20 is stored in flat or folded condition as illustrated in FIG. 7. To use the bag, gusset panels 26 are folded outwardly to expand opening 46 for receiving fill spout 48 through which fluent powdered or granular material, or the like, is charged into the bag. While the bag is being filled, entrained air entering the bag along with the material begins to escape from the bag through the vent passageway system extending from inlets 102 to outlet ports 104. If the venting air were permitted to flow in a straight line from the bag interior toward outlet ports 104, the air would tend to entrain material just charged into the bag and expel it through the outlet ports. Sealed region 92 forms a baffle which diverts the flow of air outwardly toward inlets 102, thereby causing the air to flow in a tortuous path and obstructing loss of material from the bag with the venting air. When the bag has been filled, nozzle 48 is withdrawn from opening 46. Sealed regions 96,98 cooperate with closure seal 40 to prevent inner flap portion 84 from being pulled outwardly into or beyond opening 46 when nozzle 48 is withdrawn therefrom.

The contents of the filled bag cause the bag to assume the square end or generally rectangular shape illustrated in FIG. 2, which flattens against each other the surfaces which define opening 46. On the one hand, this prevents the contents of the bag from escaping, but on the other hand, it impedes venting from the bag of entrained air which has entered the bag along with the powdered or granular material. In the conventional bag, this trapped air forms what may be termed a bubble which causes front and back panels 22,24 to bulge, and this bulging interferes with immediate stacking and subsequent handling of a group of bags. This air vents so slowly through collapsed opening 46 as to impede high rate production substantially. With the present invention, however, this trapped air readily escapes through passageway system 102,104, which facilitates proper stacking and handling of the bags substantially immediately after filling.

Preferably, flap 52 is made of a material which is thinner and more flexible than that of tube 54 with the result that when filled bag 20 assumes the flat or rectangular end shape of FIG. 2, inwardly projecting portion 84 of the flap is easily folded to flattened condition and thereby forms an effective check to the escape of the contents of the bag through valve opening 46. This improved check facilitates the use of an opening 46 which is larger than that of the conventional opening which, in turn, facilitates faster filling of a bag 20. Vent passageway system 102,104 is adequate to vent a bag 20 effectively at the resulting increased production rate.

In a typical bag according to the present invention, point 62 from which gusset panels 26 are folded outwardly is located below upper edges 36,38 of the front and back panels by a distance about twice the width of the gusset panels plus an additional one-quarter inch or so. As a result, corner panel 64 defines an opening 46 having an inner peripheral dimension of about four times the width of gusset panels 26 with the extra one-quarter inch providing the material for seam 40. Flap 52 has approximately the same length so that it can completely line the interior of opening 46 with strips adjacent its ends to form seam 40*a* and a portion of seam 40 as described. Sealed regions 90 are provided in sufficient number and extend away from edge 70 a distance adequate to insure that flap 52 will remain anchored to panel 64 adjacent edge 70 while providing minimal resistance to the flow of air through ports 104. The generally perpendicular direction of regions 90 relative to edge 70 also minimizes such resistance.

While the invention has been disclosed with reference to a bag formed of thermoplastic material, it is within the scope of the invention to form the bag of other materials, such as paper, with a flap 52 or the equivalent of such other material secured within opening 46 by such means as adhesive coated regions.

Shown in FIGS. 12–18 is a modified form of bag 120 which is similar to bag 20 except that flap 122 has two plies 124 and 126. The plies may conveniently be provided by a single sheet of thermoplastic material folded upon itself at 128. One ply is longer than the other so that it projects axially into the interior of bag 120 beyond the axially inner edge 129 of the other ply. In the structure illustrated, radially inner ply 126 is the longer. Plies 124,126 are provided, respectively, with a series of openings 130,132, and preferably, the openings of the two series register with each other when flap 122 is in folded condition. Preferably, each ply is made of a material having about one-half the thickness of that forming tube 54 for a purpose to be described.

As in the form of the invention first described, flap 122 is fitted within panel 64 with the outer surfaces of outer ply 124 opposed to the inner surfaces of panel 64 and with openings 130,132 disposed axially outwardly of inner edge 86 of the panel. The flap has corner portions 134,136 with upper edges 138,140, respectively, which are disposed in extension of upper edges 36,38 of panels 22,24. Corners 134,136 extend axially outwardly of outer edge 58,60 of panel 64 and the outwardly projecting corner portions are interconnected by outwardly projecting rectangular panels 142,144. Corners 134,136 and panels 142,144 have a common outer edge formed by fold line 128.

With flap 122 assembled to the general bag structure as described, the assembly is placed in a suitable conventional heat sealing fixture in which the outer surface portions of ply 124 are sealed to the opposed inner surface portions of panel 64 adjacent diagonal folds 54,56 as at 146, along a line 148 extending adjacent edge 58,60 of panel 64, along a line 150 adjacent inner edge 86 of panel 64, and intermittently as at 152 along lines which extend between inner corners 94 of triangular panels 66 and outer corners 154 of the triangular panels where they adjoin outer edge 58,60 of panel 64. The axially inward extension of radially inner ply 126 of the flap is also sealed to the inner surfaces of front and back bag panels 22,24 along lines 156 in extension of intermittent lines 152. During the sealing procedure, plies 124,126 are sealed together along lines 146–152. As in the form of the invention first described, upper edges 36,38 of bag panels 22,24 together with the upper edge portions of flap 122 are sealed together to form closure seam 40, and during this step, upper edge portions 138,140 of the flap are sealed together so that outwardly projecting portions 134, 136, 142 and 144 of the flap form a cuff 158 (FIGS. 15 and 16) which projects away from opening 46.

The air passageway system in this form of the invention has two branches, each with an inlet 160 at the inner edges of flap ply 126 above seals 156. Each branch extends between ply 126 and a front of back panel 22,24. Part of the air from the two branches enter one common passageway 162 (FIG. 13) between plies 124,126, and part of the flow from the two branches enters another common passageway 164 between ply 124 and panel 64. Entry of the air into the common passageways is through two series of ports 166 in alternate arrangement with the series of intermittent seals 152. The air flowing in passageway 164 passes through openings 132 in outer flap ply 124 into passageway 162 and finally the combined flows vent to the exterior of bag 120 through openings 130 in inner ply 126.

Seal line 150 forms an obstruction similar to seal line 92 of bag 20 which causes the venting air to follow a tortuous path to minimize expelling contents of the bag through the vent passageway. In addition, intermittent seals 152 form turbulence in the air flow adjacent ports 166 further minimizing expulsion of the bag's contents.

The reason for making flap 122 of a material thinner than that of tube 54 is to provide that part of the flap which extends to the interior of bag 120 beyond seam 152 with ready flexibility so that it can be easily folded or otherwise deformed to form an effective check to egress of the bag's contents through opening 46 after the bag has been filled. However, it is desirable that cuff 158 be stronger and less flexible since bag 120 derives support during the filling procedure by engagement of the cuff around fill spout 48. The two-ply structure of the cuff provides the desired support.

Figure 19:
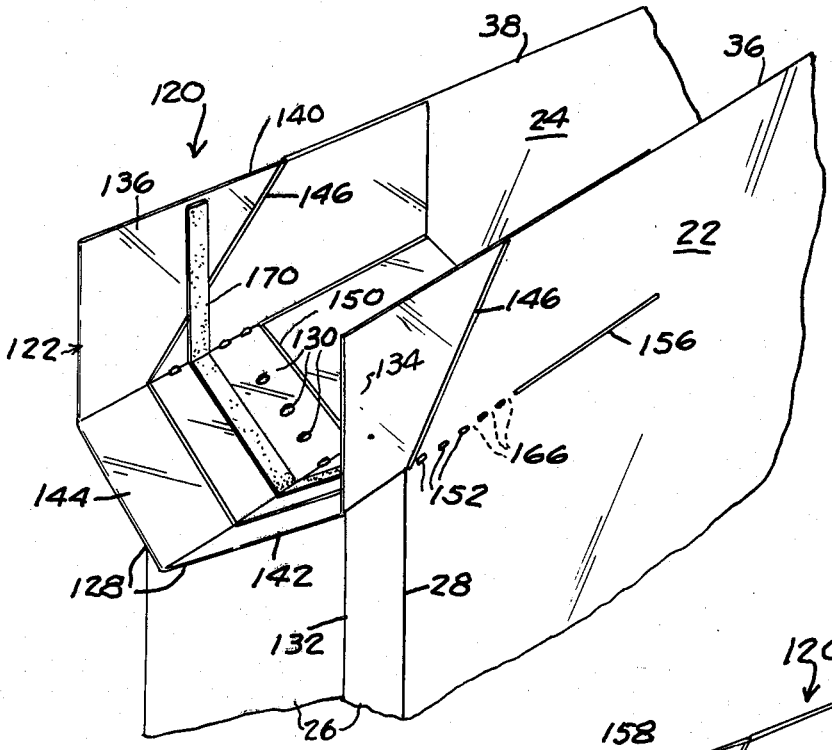
FIG. 19 is a fragmentary perspective view similar to FIG. 12 but showing a modification which employs a strip of contaminant barrier tape.
Figure 16:
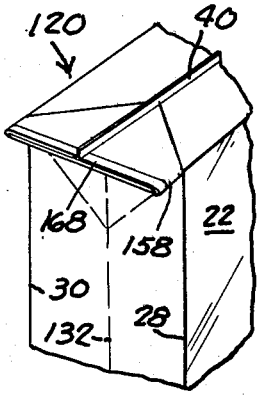
FIG. 16 is a fragmentary perspective view of the bag of FIG. 15 in filled condition.
Figure 20:
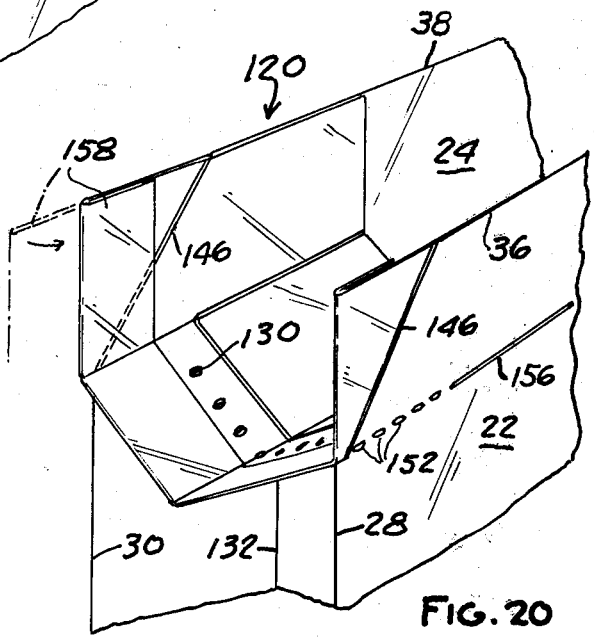
FIG. 20 is a view similar to FIG. 19 and illustrating a step in use of the tape.
Figure 15:
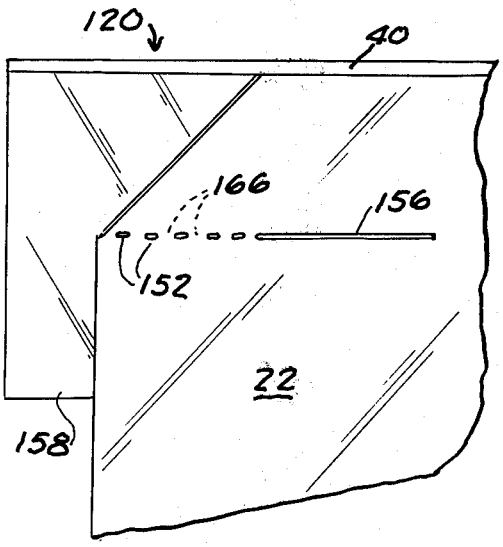
FIG. 15 is a fragmentary side elevational view of the bag of FIG. 12 in completed condition.
Figure 17:
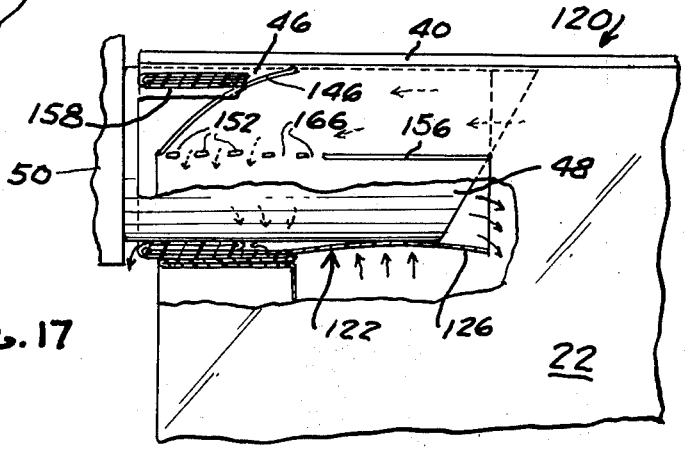
FIG. 17 is a fragmentary side elevational view of the filled bag of FIG. 16 with parts broken away and shown in section.
Figure 18:
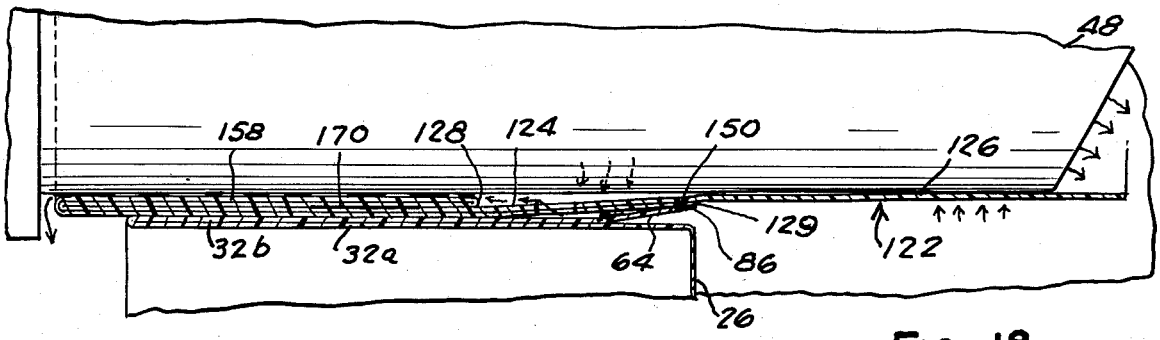
FIG. 18 is an enlarged scale fragmentary view of portions of the structure shown in FIG. 17.

Bag 120 being formed of a thermoplastic material is inherently moisture proof except for opening 46. Should it be desired to provide a moistureproof closure for opening 46, inner surfaces of cuff 158 can be heat sealed together as at 168 (FIG. 16). Some materials such as flour, cement or other powders tend to coat the interior surfaces of cuff 158, and such coating interferes with effective heat sealing of the cuff surfaces together. To protect the cuff surfaces from formation of such coating, bag 120 may be provided with a strip of two-sided adhesive tape 170 (FIG. 19). The strip is secured around the inner periphery of opening 46 by one adhesive face, and the other adhesive face exposed inwardly. Prior to filling the bag, cuff 158 is folded inwardly so that its interior surface engages and adheres to tape 170. The tape forms a barrier to coating interior surfaces of the cuff so that after the filling procedure the cuff can be folded outwardly and its uncoated surfaces heat sealed together.

Figure 21:
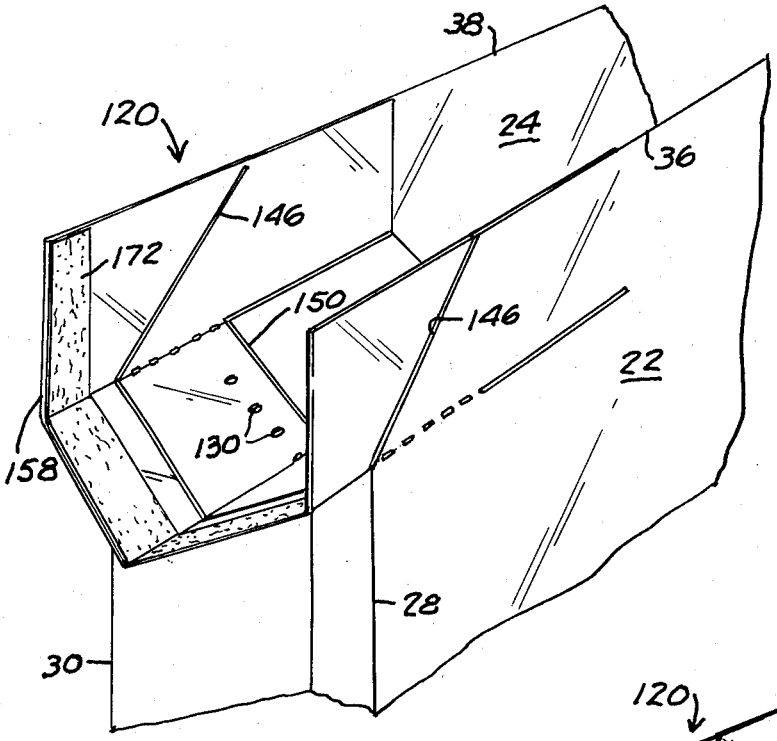
FIG. 21 is a view similar to FIG. 19 but showing a modified application of the contaminant barrier tape.
Figure 23:
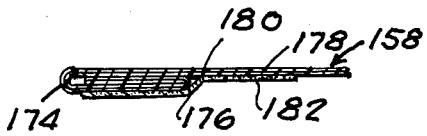
FIG. 23 is an enlarged scale sectional view on line 23—23 of FIG. 22.
Figure 22:
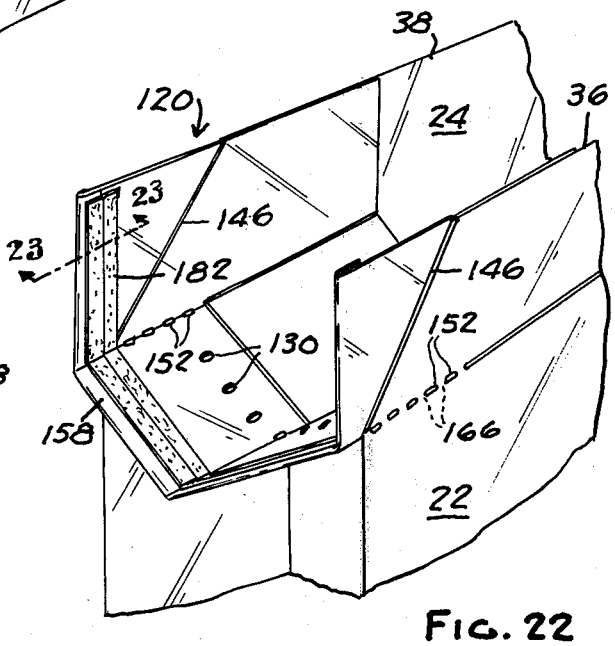
FIG. 22 is a view similar to FIGS. 19 and 21 but showing a further modification in the use of the tape.

A modified form of contaminant barrier shown in FIG. 21 comprises a strip of one-sided adhesive tape 172 secured around the interior of cuff 158 adjacent its edge portion distal of opening 46. The cuff need not be folded inwardly to protect its heat sealable surfaces from contamination. After the bag has been filled, tape 172 is merely stripped off and the edge portions of the cuff interior heat sealed together. A further variation of contaminant barrier is illustrated in FIGS. 22 and 23 wherein edge portions of the cuff are folded inwardly on themselves at 174 and 176, the folded portions adjoining the unfolded portion 178 of the cuff at a juncture 180. Adhesive tape 182 is applied over juncture 180 and adjacent folded and unfolded portions of the cuff. The folded cuff with the tape need not be folded into opening 46 while the bag is being filled. After the bag has been filled, tape 182 is stripped off, cuff 158 is unfolded, and its interior surfaces can then be heat sealed together.

I claim:

1. A vented bag formed of a thermoplastic sheet material having a pair of side walls connected along their vertical edges by inwardly gusseted end walls, said side walls being heat sealed together along a generally straight line at the upper ends thereof to form a top closure for the bag, at one upper corner portion of the bag one end wall having a portion thereof folded inwardly along a line extending between the adjacent vertical edges of the two side walls and spaced downwardly from the top closure seal such that in the flattened condition of the bag the inwardly folded portion of said end wall cooperates with the portion of the end wall immediately below it to define a pair of double thickness, triangularly-shaped panels sandwiched between the adjacent portions of the side walls, said side walls being folded inwardly along lines extending diagonally inwardly and upwardly from the opposite ends of the last-mentioned fold line on the end wall to the line of sealing at said top closure, said inwardly folded end and side walls defining an opening at said corner of the bag, a tubular sleeve of thermoplastic sheet material disposed in said opening, said sleeve comprising an axially outer end portion which extends outwardly from the inner edge of the inwardly folded portion of said end wall and an axially inner portion which extends downwardly from said inner edge of the inwardly folded portion of said end wall, said tubular sleeve being connected to the inner edge of said inwardly folded portion of said end wall by a continuous heat seal, said outer end portion of said sleeve being heat sealed to said inwardly folded portion of said end wall adjacent said fold line thereon and also being heat sealed to each side wall along said diagonal fold lines, said inner end portion of said sleeve being heat sealed along said top closure and to both side walls along lines which are spaced downwardly from and generally parallel to said top seal, said last-mentioned lines of sealing extending axially inwardly of the opening from the opposite ends of the heat seal along said inner edge of the inwardly folded portion of the end wall, said heat seals along said inner edge of the inwardly folded portion of the end wall and along said parallel lines on the inner end portion of said sleeve preventing the inner end portion of the sleeve from being displaced in a direction outwardly of the opening when the bag is filled with product, said seals defining a pair of first passageways extending from inside the bag in a direction outwardly of the opening to said diagonal seals between the sleeve and each side wall and a second air passageway extending circumferentially of the opening from the outer ends of the first passageways and between the inwardly folded portion of the end wall and the axially outer end portion of said sleeve, and means providing vent holes in said second passageway to permit the escape of air therefrom to the exterior of the bag while the bag is being filled with product through a filling spout inserted into said sleeve and also after the bag is filled and the sleeve is collapsed against itself into a flattened condition by the product in the bag.

2. A vented bag as called for in claim 1 wherein the plastic sheet comprising the tubular sleeve is substantially thinner than the plastic sheet comprising the bag.

3. A vented bag as called for in claim 1 wherein the outer end portion of said sleeve comprises two plies of said sleeve sheet material and the inner portion of the sleeve comprises a single ply of said sleeve sheet material.

4. A vented bag as called for in claim 3 wherein the axially outer end of said sleeve comprises a circumferentially extending fold line between said two plies of sheet material.

5. A vented bag as called for in claim 3 wherein the inner end portion of said sleeve comprises an axial extension of the radially inner ply of the outer end portion of said sleeve.

6. A vented bag as called for in claim 3 wherein said vent holes are formed in both plies of the outer sleeve portion.

7. A vented bag as called for in claim 6 wherein said vent holes are disposed intermediate said fold line of said end panel and the inner edge thereof.

8. A vented bag as called for in claim 7 wherein said vent holes are in registered relation in both plies of said outer end portion of said sleeve.

9. A vented bag as called for in claim 3 wherein the outer end portion of the sleeve extends outwardly beyond the the fold line in said end wall and is connected to said end wall at said last-mentioned fold line by a heat seal which extends continuously between the lower ends of said heat seals along said diagonal fold lines.

10. A vented bag as called for in claim 9 wherein the vent holes are spaced inwardly of said fold line in the end wall a distance such that when the outer end portion of the sleeve is folded inwardly upon itself along a line registering with the fold line in the end wall said vent holes are spaced inwardly therefrom.

11. A vented bag as called for in claim 3 wherein said parallel lines of sealing are extended axially outwardly beyond said inner edge of said end wall as spaced apart seals to form a plurality of spaced junctions between the opposite ends of said circumferential passageway and the outer ends of said first passageways.

* * * * *

UNITED STATES PATENT AND TRADEMARK OFFICE

CERTIFICATE OF CORRECTION

PATENT NO. : 4,071,187

DATED : January 31, 1978

INVENTOR(S) : Arthur E. LaFLEUR

It is certified that error appears in the above-identified patent and that said Letters Patent are hereby corrected as shown below:

column 7, Line 10 Cancel "downwardly" and insert in place thereof -- inwardly -- column 8, Line 24 Cancel "registered" and insert in place thereof -- registering --

Signed and Sealed this

*Tenth* Day of *July 1979*

[SEAL]

*Attest:*

*Attesting Officer*

LUTRELLE F. PARKER

*Acting Commissioner of Patents and Trademarks*